US011155978B2

(12) United States Patent
Szebalskie, Sr. et al.

(10) Patent No.: US 11,155,978 B2
(45) Date of Patent: Oct. 26, 2021

(54) COMPRESSED NETTING SLEEVE FOR IN SITU MANUFACTURE OF COMPOST FILTER SOCKS AND METHOD OF FORMING COMPOST FILTER SOCKS USING SAME

(71) Applicant: MKB Company, Groveport, OH (US)

(72) Inventors: Jeffrey Karl Szebalskie, Sr., Mars, PA (US); Michael Zock, Saxonburg, PA (US)

(73) Assignee: MKB COMPANY, LLC, Groveport, OH (US)

( * ) Notice: Subject to any disclaimer, the term of this patent is extended or adjusted under 35 U.S.C. 154(b) by 683 days.

(21) Appl. No.: 15/631,705

(22) Filed: Jun. 23, 2017

(65) Prior Publication Data

US 2017/0298589 A1 Oct. 19, 2017

Related U.S. Application Data

(62) Division of application No. 14/449,288, filed on Aug. 1, 2014, now abandoned.

(60) Provisional application No. 61/866,463, filed on Aug. 15, 2013.

(51) Int. Cl.
*E02D 29/02* (2006.01)

(52) U.S. Cl.
CPC ..... *E02D 29/0291* (2013.01)

(58) Field of Classification Search
None
See application file for complete search history.

(56) References Cited

U.S. PATENT DOCUMENTS

| | | | | |
|---|---|---|---|---|
| 2,079,779 A | | 5/1937 | Tullis | |
| 2,201,279 A | | 5/1940 | Willing | |
| 2,425,301 A | * | 8/1947 | Browner | B65D 85/07 206/83.5 |
| 2,627,153 A | * | 2/1953 | Stencil | B65B 11/105 53/138.2 |
| 3,097,644 A | | 7/1963 | Parker | |
| 3,263,682 A | | 8/1966 | Rosenfield | |
| 3,407,562 A | * | 10/1968 | Di Nicola | H01G 4/38 53/436 |

(Continued)

OTHER PUBLICATIONS

EPA, Stormwater Best Management Practice Compost Blankets, www.epa.gov/npdes/pubs/compostblankets.pdfOffice of Water, 4203M, EPA 833-F-11-007, Mar. 2012.

(Continued)

*Primary Examiner* — Hemant Desai
*Assistant Examiner* — Tanzim Imam
(74) *Attorney, Agent, or Firm* — Blynn L. Shideler; Krisanne Shideler; BLK Law Group

(57) ABSTRACT

A compressed netting sleeve for in situ formation of a compost filter sock comprises a sleeve of netting material having a pair of opposed open ends, wherein the sleeve of netting material is bunched primarily along a longitudinal axis, whereby each of the open ends of the netting material remains accessible to form a compression bundle netting material; and a protective sleeve extending through the open ends of the sleeve of netting material to extend through the interior of the sleeve of netting material and around the exterior of the sleeve of netting material thereby surrounding the compression bundle netting material with the protective sleeve.

19 Claims, 6 Drawing Sheets

(56) References Cited

U.S. PATENT DOCUMENTS

| | | | | |
|---|---|---|---|---|
| 3,617,566 | A | 11/1971 | Oshima et al. | |
| 3,739,913 | A | 6/1973 | Bogosian | |
| 3,794,268 | A | 2/1974 | McNeill | |
| 3,957,098 | A | 5/1976 | Hepworth et al. | |
| 4,044,525 | A | 8/1977 | Forsgren | |
| 4,174,416 | A | 11/1979 | Mercer | |
| 4,247,005 | A | 1/1981 | Buxton | |
| 4,366,067 | A | 12/1982 | Golding et al. | |
| 4,659,478 | A | 4/1987 | Stapelfeld et al. | |
| 4,790,105 | A * | 12/1988 | Wareing | B65D 85/52 47/84 |
| 5,009,058 | A | 4/1991 | Ptaschek | |
| 5,692,606 | A * | 12/1997 | Elmaleh | B65B 25/20 206/278 |
| 5,727,277 | A | 3/1998 | Chlen | |
| 5,782,067 | A * | 7/1998 | Fuss | B65B 9/15 53/137.2 |
| 5,867,825 | A | 2/1999 | Scheerer | |
| 5,899,049 | A | 5/1999 | Fuss | |
| 6,044,525 | A | 4/2000 | Sastre | |
| 6,092,257 | A | 7/2000 | Chen | |
| 6,182,421 | B1 | 2/2001 | Sullivan | |
| 7,178,224 | B2 * | 2/2007 | Bussey, Jr. | E02B 11/00 29/407.09 |
| 7,226,240 | B2 * | 6/2007 | Tyler | E02B 3/127 210/170.03 |
| 7,452,165 | B2 * | 11/2008 | Tyler | E02B 3/125 405/302.6 |
| 7,600,308 | B2 | 10/2009 | Bussey, Jr. | |
| 2004/0026292 | A1 | 2/2004 | Ours | |
| 2004/0079699 | A1 * | 4/2004 | Engwer | E02B 3/125 210/602 |
| 2004/0107675 | A1 * | 6/2004 | Nelson | A47C 3/16 53/416 |
| 2005/0155327 | A1 | 7/2005 | Snell | |
| 2006/0021292 | A1 | 2/2006 | Norton | |
| 2006/0075620 | A1 | 4/2006 | Bussey, Jr. | |
| 2006/0105690 | A1 | 5/2006 | Wince | |
| 2008/0098691 | A1 | 5/2008 | Pinto | |
| 2008/0152267 | A1 | 6/2008 | Shannon | |
| 2008/0236103 | A1 | 10/2008 | Lowder | |
| 2009/0308769 | A1 | 12/2009 | Mitter | |
| 2011/0085749 | A1 | 4/2011 | Frei | |
| 2012/0020745 | A1 * | 1/2012 | Miller | E02D 29/0208 405/284 |

OTHER PUBLICATIONS

EPA, Water: Best Managment Practices, Compost Filter Socks, http://water.epa.gov/polwaste/npdes/swbmp/Compost-Filter-Socks.cfm, Tuesday, Jul. 1, 2014.

EPA, Water: Best Management Practices, Compost Filter Berms, http://water.epa.gov/polwaste/npdes/swbmp/Compost-Filter-Berms.cfm, Tuesday, Jul. 1, 2014.

US Composting Council, USCC factsheet: Using Compost in Stormwater Management, http://www.sandiego.gov/environmental-services/pdf/miramar/CompostStormwaterManagement.pdf, Copyright © 2008 The United States Composting Council.

Dr. Britt Faucette, Temporary Barriers as BMPs, Revisited, http://www.erosioncontrol.com/EC/Articles/Temporary_Barriers_as_BMPs_Revisited_9264.aspx, Wednesday, Jan. 13, 2010.

* cited by examiner

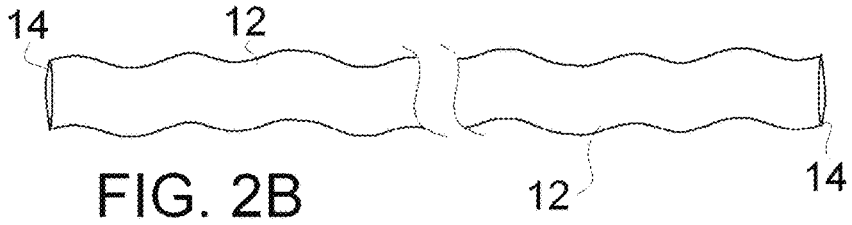
FIG. 2B
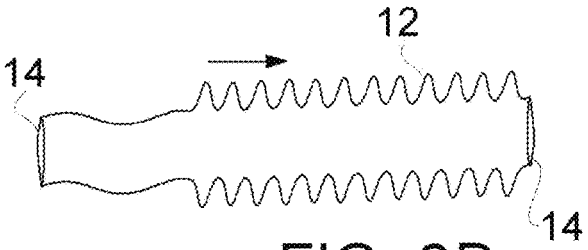
FIG. 2D
FIG. 2E
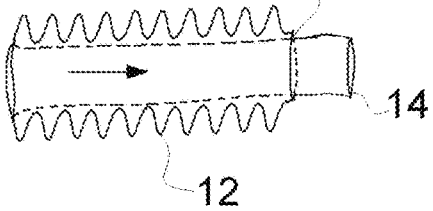
FIG. 2F
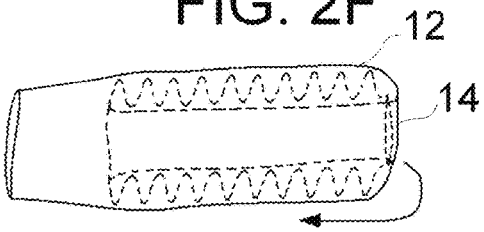
FIG. 2H
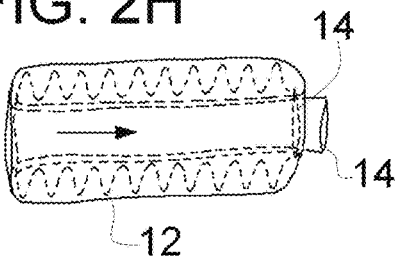
FIG. 5
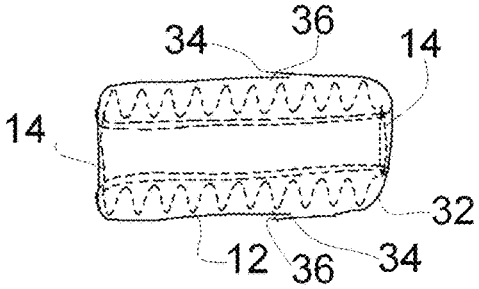

COMPRESSED NETTING SLEEVE FOR IN SITU MANUFACTURE OF COMPOST FILTER SOCKS AND METHOD OF FORMING COMPOST FILTER SOCKS USING SAME

RELATED APPLICATIONS

This application is a divisional application of U.S. patent application Ser. No. 14/449,288, abandoned, filed Aug. 1, 2014 entitled "Method of Forming a Vacuum Packed Compressed Netting Sleeve for In Situ Manufacture of Compost Filter Socks and Method of Forming Compost Filter Socks Using Same" and which published on Feb. 19, 2015 as U.S. patent Publication Number 2015/0047298, which publication is incorporated herein by reference.

U.S. patent application Ser. No. 14/449,288 claims priority to U.S. Patent Application Ser. No. 61/866,463 entitled "Method of Forming a Vacuum Packed Compressed Netting Sleeve for In Situ Manufacture of Compost Filter Socks and Method of Forming Compost Filter Socks Using Same" which is incorporated herein by reference.

BACKGROUND INFORMATION

1. Field of the Invention

The present invention relates to a compressed netting sleeve for in situ manufacture of compost filter socks and a method of forming compost filter socks using same and to onsite storage of residual sleeve material.

2. Background Information

A compost filter sock (also called a compost filter sleeve, or silt sleeve, or filter sock, compost filter tube, compost mesh sleeve, or similar terms) is a type of contained compost filter berm. A compost filter sock is a mesh tube or netting sleeve filled with mostly composted material and that is conventionally placed perpendicular to sheet-flow runoff to control erosion and retain sediment in disturbed areas. The idea of a filter sock formed as a mesh tube filled with compost material as the filler goes at least as far back as 1935 in a patent application by Mark S. Willing for a "means for preventing soil erosion." At that time, the time of the "dust bowl" in the central United States, soil erosion was a big problem in the United States and wind and water erosion was destroying large swaths of cropland. Mr. Willing's early compost filter sock U.S. Pat. Nos. 2,079,779 and 2,201,279, which are incorporated herein by reference, disclosed the use of brush or bundled weeds as the compost filler for these early filter socks.

Over the years improvements have been developed giving further detail to filler material, opening size in the frameless mesh, length and size of filters, installation instructions. See, for example U.S. Pat. No. 3,957,098, which is incorporated herein by reference, disclosing a 1972 development of an erosion control bag having a porosity of 10 to 35 cubic feet per minute so that air and water may escape from the bag as water and a filler are pumped into the bag. U.S. Pat. No. 4,044,525, which is incorporated herein by reference, discloses a 1975 development wherein wood chips are blown from the discharge tube of the wood chipper straight into a tube-like package which has perforated walls allowing the air carrying the wood chips to escape from the package while the chips are retained inside the package. The analogous oil skimming/spill absorbing field, which used absorbent material (including compostable material) in netting, has also yielded improvements relevant to compost filter socks as evidenced in U.S. Pat. Nos. 3,617,566, 3,739,913, 4,366,067, and 4,659,478, which are incorporated herein by reference.

Within the last 30 years, tubular compost filter socks filled with straw and hammered wood have been introduced. In the late 1990's filter berms where introduced. The berm was basically a triangular windrowed pile of decomposing organic material from land clearing, tree-trimming, or other sources. Some of the people doing work early in the evolution and proliferation and re-introduction of modern compost filter sock were John Engwer at FilterMitt, Kevin Lane at Lane ECS, Tom Truelsen at Soil Tek, Rod Tyler at Filtrexx, Keith and Kevin Weaver at Weaver Express, and Doug Cadwell at River Valley Organics. Soon a "modern day" tubular mesh fabric holding in place the berm material was introduced and the term "Compost Filter Sock" began to be used. Today's compost filter sock is a modern day version of the original Willing patents.

Maine was one of the first states to embrace compost filter socks and associated standards. In the past 10-15 years, most other states have followed suit. As of 2014, at least one Standard Setting Organization (SSO) in every state has adopted a "Compost Filter Sock" standard.

The modern compost filter socks are typically oval in cross section, once formed, although the netting sleeve is often circular in cross section prior to filling. A compost filter sock, provides a three-dimensional filter that retains sediment and other pollutants (e.g., suspended solids, nutrients, and motor oil) while allowing the cleaned water to flow through (See Faucette, et al. 2005. *Evaluation of Storm water from Compost and Conventional Erosion Control Practices in Construction Activities*, Journal of Soil and Water Conservation, 60:6, 288-297; and Tyler, R. and B. Faucette 2005. *Organic BMPs used for Storm water Management—Filter Media Test Results from Private Certification Program Yield Predictable Performance*, U.S. Composting Council 13$^{th}$ Annual Conference and Trade Show, January 2005, San Antonio, Tex.).

The compost filter socks are used in place of a traditional sediment and erosion control tool, such as a silt fence or straw bale barrier. Composts used in compost filter socks are conventionally made from a variety of feed-stocks, including municipal yard trimmings, food residuals, separated municipal solid waste, bio-solids, and manure. Compost filter socks are generally placed along the perimeter of a site, or at intervals along a slope, to capture and treat storm-water that runs off as sheet flow. Compost filter socks are flexible and can be filled in place or filled and moved into position, making them especially useful on steep or rocky slopes where installation of other erosion control tools is not feasible. There is greater surface area contact with soil than typical sediment control devices, thereby reducing the potential for runoff to create rills under the device and/or create channels carrying unfiltered sediment. Additionally, compost filter socks can be laid adjacent to each other, perpendicular to storm-water flow, to reduce flow velocity and soil erosion. Compost filter socks can also be used on pavement as inlet protection for storm drains and to slow water flow in small ditches.

Compost filter socks used for erosion control are most commonly 12 inches in diameter, although 8 inch, 18 inch, and 24 inch diameter compost filter socks are used in some applications. The smaller 8 inch diameter filter socks are commonly used as storm-water inlet protection. The "diameter" of the compost filter sock is typically given as the diameter of the unfilled netting sleeve used to form the compost filter sock, as in position, gravity will make the cross section take an oval or "D" shape in which the width of the device exceeds the original diameter and the height of the device is less than the original diameter.

Compost filter socks can be what are termed "vegetated" or "un-vegetated". Vegetated compost filter socks can be left in place to provide long-term filtration of storm-water as a post-construction best management practice. The vegetation grows into the slope, further anchoring the compost filter sock. Un-vegetated compost filter socks are often cut open when the project is completed, and the compost filling is spread around the site as soil amendment or mulch. The netting sleeve is then disposed of unless it is biodegradable.

According to the U.S. Environmental Protection Agency's National Pollutant Discharge Elimination System description of Construction Site Storm-water Runoff Control, three advantages the compost filter sock has over traditional sediment control tools, such as a silt fence, are: i) Installation does not require disturbing the soil surface (no trenching), which reduces erosion; ii) It is easily removed; and iii) The operator must dispose of only a relatively small volume of material, if any. These advantages lead to cost savings, either through reduced labor or disposal costs.

Further, the use of compost provides additional benefits. The compost retains a large volume of water, which helps prevent or reduce rill erosion and aids in establishing vegetation on the filter sock. The mix of particle sizes in the compost filter material retains as much or more sediment than traditional perimeter controls, such as silt fences or hay bale barriers, while allowing a larger volume of clear water to pass through (Silt fences often become clogged with sediment and form a dam that retains storm-water, rather than letting the filtered storm-water pass through). In addition to retaining sediment, compost can retain pollutants such as heavy metals, nitrogen, phosphorus, oil and grease, fuels, herbicides, pesticides, and other potentially hazardous substances—improving the downstream water quality. Nutrients and hydrocarbons adsorbed and/or trapped by the compost filter can be naturally cycled and decomposed through bioremediation by microorganisms commonly found in the compost matrix.

Compost filter socks are applicable to construction sites or other disturbed areas where storm-water runoff occurs as sheet flow. Common industry practice for compost filter devices is that drainage areas do not exceed 0.25 acre per 100 feet of device length and flow does not exceed one cubic foot per second. Compost filter socks can be used on steeper slopes with faster flows if they are spaced more closely, stacked beside and/or on top of each other, made in larger diameters, or used in combination with other storm-water controls, such as compost blankets. Once the filter sock is filled and put in place, it should be anchored to the slope. The preferred anchoring method is to drive stakes through the center of the sock at regular intervals; alternatively, stakes can be placed on the downstream side of the sock. The ends of the filter sock should be directed upslope, to prevent storm-water from running around the end of the sock. The filter sock may be vegetated by incorporating seed into the compost prior to placement in the filter sock. Since compost filter socks do not have to be trenched into the ground, they can be installed on frozen ground or even on cement or other "inhospitable" surfaces.

Compost filter socks offer a large degree of flexibility for various applications. A large number of qualitative studies have reported the effectiveness of compost filter socks in removing settleable solids and total suspended solids from storm-water. These studies have consistently shown that compost filter socks are generally more effective than traditional erosion and sediment control systems. Compost filter socks are often used in conjunction with compost blankets to form a storm-water management system. Together, these two systems retain a very high volume of storm-water, sediment, and other pollutants. For further background see, Alexander, R. 2003. *Standard Specifications for Compost for Erosion/Sediment Control* developed for the Recycled Materials Resource Center, University of New Hampshire, Durham, N.H.; Alexander, R. 2001. *Compost Use on State Highway Applications*, Composting Council Research and Education Fund and U.S. Composting Council, Harrisburg, Pa.; AASHTO. 2003 Standard Specifications for Transportation Materials and Methods of Sampling and Testing, Designation MP-9, Compost for Erosion/Sediment Control (Filter Berms), Provisional, American Association of State Highway Officials, Washington, D.C; Glanville et al. 2003. *Impacts of Compost Blankets on Erosion Control, Revegetation, and Water Quality at Highway Construction Sites in Iowa*, T. Glanville, T. Richard, and R. Persyn, Agricultural and Biosystems Engineering Department, Iowa State University of Science and Technology, Ames, Iowa; Juries, D. 2004. *Environmental Protection and Enhancement with Compost*, Oregon Department of Environmental Quality, Northwest Region; McCoy, S. 2005. Filter Sock Presentation provided at Erosion, *Sediment Control and Stormwater Management with Compost BMPs Workshop*, U.S. Composting Council 13th Annual Conference and Trade Show, January 2005, San Antonio, Tex.; MnDOT. 2005. *Storm Drain Inlet Protection Provisions, S-5.5 Materials*, B. Compost Log, Minnesota Department of Transportation, Engineering Services Division, Technical Memorandum No. 05-05-ENV-03, Jan. 18, 2005; ODEQ. 2004. Best Management Practices for Stormwater Discharges Associated with Construction Activity, Guidance for Eliminating or Reducing Pollutants in Stormwater Discharges, Oregon Department of Environmental Quality, Northwest Region; USCC. 2001. *Compost Use on State Highway Applications*, U.S. Composting Council, Washington, D.C; USEPA. 1998. *An Analysis of Composting as an Environmental Remediation Technology*. U.S. Environmental Protection Agency, Solid Waste and Emergency Response (5305W), EPA530-R-98-008, April 1998; and W&H Pacific. 1993. Demonstration Project Using Yard Debris Compost for Erosion Control, Final Report, presented to Metropolitan Service District, Portland, Oreg. The details of making the conventional compost filter socks are also described in some detail in U.S. Pat. Nos. 7,226,240 and 7,452,165 which are incorporated herein by reference.

Compost filter socks are assembled by tying a knot in one end of the mesh sock, filling the sock with the composted material, typically usually using a pneumatic blower then knotting the other end once the desired length is reached. Often this is done in-situ by having a pneumatic blower on site, which in this context is also called a blower truck as it is typically mounted on a vehicle. The appropriate compost is delivered to the site in bulk, or manufactured at the site (which minimizes waste removal from vegetation removal during site preparation), or a combination of these. The netting sleeve is also delivered to the site and typically comes in large rolls or coils. The operator of the pneumatic blower must unravel an entire length of netting sleeve from the coil, and then load the entire desired netting sleeve length onto the nozzle of the blower to form what is referenced herein as a compression bundle. Once "loaded" the leading end and knot the end before beginning filing. The trailing end is knotted after the compost filter sock of the desired length is formed. Further, the operators do not have a convenient method of storing the residual length of netting sleeve after the day/job has been completed, and this can lead to the loss of considerable amount of unused netting between "runs".

There remains a need in the art for a cost effective method to distribute the netting sleeves used to form compost filter socks and facilitate the construction of compost filter socks in situ.

SUMMARY OF THE INVENTION

This invention is directed to a method of forming a vacuum packed compressed netting sleeve for in situ formation of a compost filter sock which comprises the steps of: providing a sleeve of netting material having at least one open end; bunching the sleeve of netting material primarily along a longitudinal axis, whereby each open end of the netting material remains accessible to form a compression bundle netting material; placing the compression bundle netting material in a re-sealable weatherproof bag; drawing a vacuum in the bag to compress the compression bundle netting material; and sealing the bag.

A mechanical fastener capable of securing a compression bundle netting sleeve in position may be provided within in the bag. The bag may efficiently store remnants of the netting sleeve at the end of given manufacturing runs.

The invention is also directed towards a method of forming a compressed netting sleeve for in situ formation of a compost filter sock comprising the steps of: providing a sleeve of netting material having two open ends; bunching the sleeve of netting material primarily along a longitudinal axis, whereby each open end of the netting material remains accessible to form a compression bundle netting material; and forming a shape holding sleeve of a torus or donut shape from the compression bundle netting material by one of i) drawing one open end of the netting material through the open interior and through the other open end then wrapped around the exterior at least once; ii) securing the compression bundle netting sleeve in position within in the bag with a mechanical fastener which is one of a twist tie, cable tie, hose tie, zip tie or tie-wrap; and iii) securing the compression bundle netting sleeve in position within in the bag with an encapsulating mesh protective sleeve.

The invention is also directed towards a method of manufacturing a compost filter sock comprising the steps of: providing a bag containing a compression bundle netting sleeve; removing the compression bundle netting sleeve from the bag; placing the compression bundle netting sleeve on a pneumatic nozzle; removing one open end and a leading length of the netting sleeve from the pneumatic nozzle while maintaining the opposite end and the remainder of the netting sleeve on the pneumatic nozzle; sealing the open end; filling the netting sleeve with compost; and sealing the remaining open end.

The phrase "compression bundle" within the meaning of this application refers to compressing or bunching of netting sleeve material primarily along a longitudinal axis thereof whereby each open end and the opening there between remains accessible. The phrase "rolled sleeve" within the meaning of this patent application references a compression bundle sleeve in which one open end is drawn through the center through the open interior and through the other open end and wrapped at least once around the exterior to form a donut or torus shaped self shape holding structure.

The features that characterize the present invention are pointed out with particularity in the claims which are part of this disclosure. These and other features of the invention, its operating advantages and the specific objects obtained by its use will be more fully understood from the following detailed description in connection with the attached figures.

BRIEF DESCRIPTION OF THE FIGURES

FIG. 5 schematically illustrates a compression bundle netting sleeve with protective holding sleeve holding the netting sleeve in position;

DESCRIPTION OF THE PREFERRED EMBODIMENTS

Figure 1A:
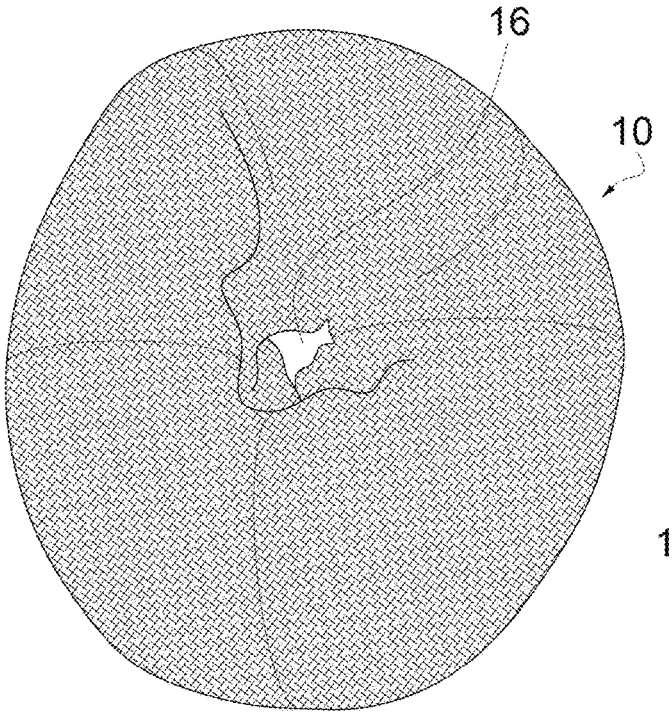
FIGS. 1 A and B are perspective views of a compression bundle netting sleeve formed as a rolled sleeve 10 in accordance with one aspect of the present invention.
FIG. 1C is a perspective view of a vacuum packed compressed netting sleeve for in situ manufacture of a compost filter stock according to one aspect of the present invention.
Figure 1B:
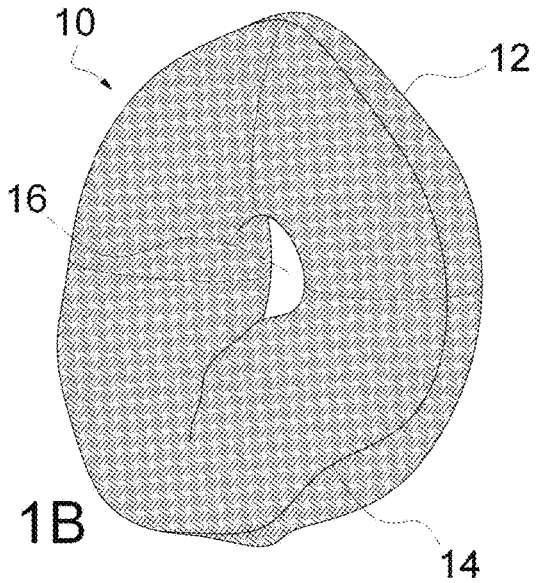

FIGS. 1 A and B are perspective views of a compression bundle netting sleeve formed as a rolled sleeve 10 in accordance with one aspect of the present invention. The rolled sleeve is formed of netting material 12, also called mesh material, having a pair of distal open ends 14. FIGS. 2A and B are side and schematic views, respectively, of the end portions of the netting sleeve material 12 forming the rolled sleeve 10 of FIGS. 1 A-C. The netting sleeve material 12 can come in any conventional size, most typically circular cross sections of 8", 10", 12", 18" and 24" being the most common. The mesh opening size can be of a variety of conventional sizes, provided that the mesh openings are small enough to maintain the compost within the constructed compost filter sock and large enough to allow runoff water to flow there through. The size and mesh opening constructions are generally known in the compost filter sock art. The netting sleeve material 12 is preferably formed of non-dye treated polyester, although polypropylene, cotton, nylon material are also known in the art and may be acceptable.

As noted above the phrase "compression bundle" within the meaning of this application refers to compressing or bunching of netting sleeve material 12 primarily along a longitudinal axis thereof whereby each open end 14 and the opening there between, generally 16, remains accessible. As described below the "rolled sleeve" 10 within the meaning of this patent application references a compression bundle netting material sleeve in which one open end 14 is drawn through the center through the open interior 16 and through the other open end 14 and wrapped at least once around the exterior to form a donut or torus shaped self shape holding structure as shown in FIGS. 1A-C.

Figure 1C:
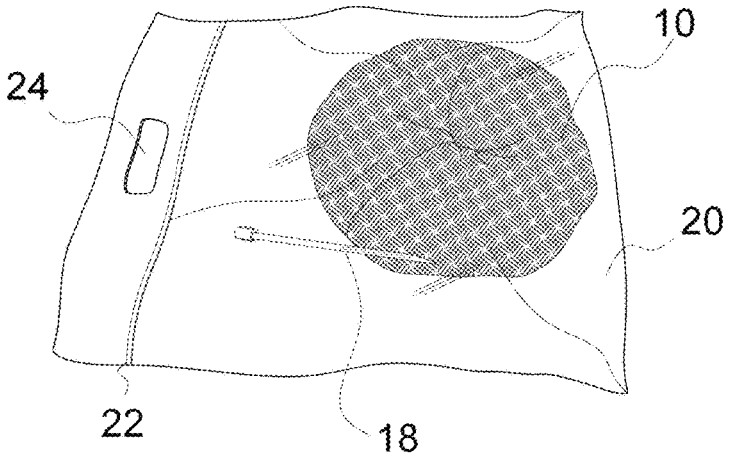
Figure 2A:
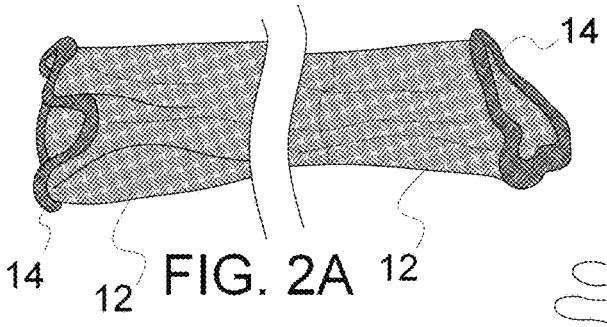
FIGS. 2A and B are side and schematic views, respectively, of the end portions of the netting sleeve material forming the rolled sleeve of FIGS. 1 A-C.

FIG. 1C is a perspective view of a vacuum packed rolled sleeve 10 packed with a mechanical fastener 18 capable of securing a compression bundle netting sleeve in position, wherein the mechanical fastener 18 is one of a twist tie, cable tie, hose tie, zip tie or tie-wrap. The rolled sleeve 10 and fastener 18 are packed in a weatherproof vacuum bag 20 which may have access through a re-sealable closure 22 and have a handle 24. The bag 20 may be easily formed as transparent plastic material as generally known in the vacuum bag art.

The essence of the formation of the vacuum packed compressed netting sleeve of the present invention can be summarized as "SLEEVE IT, HOLD IT, VACUUM PACK IT"™ which is a mark used by the applicant in promoting the compression bundle netting sleeve of the present invention.

Sleeve It

FIGS. 2 C and D illustrate the formation of a compression bundle netting sleeve from the netting sleeve material 12 of FIGS. 2A and B, wherein the process is compressing or bunching of netting sleeve material 12 primarily along a longitudinal axis thereof whereby each open end 14 and the opening there between, generally 16, remains accessible. In practice this bunching is accomplished on a center holding rod, which for short lengths up to a few hundred feet could be on the arm of a worker who is forming the compression bundle netting sleeve.

Hold It

Figure 2C:
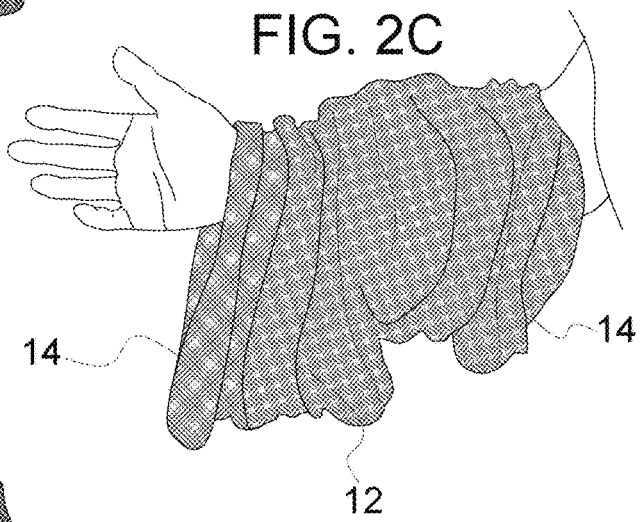
FIGS. 2 C and D illustrate the formation of a compression bundle netting sleeve from the netting sleeve of FIGS. 2A and B.
FIGS. 2E-I schematically illustrates, progressive steps for forming the rolled sleeve of FIGS. 1 A-C from a compression bundle netting sleeve of FIGS. 2C and D.
Figure 2G:
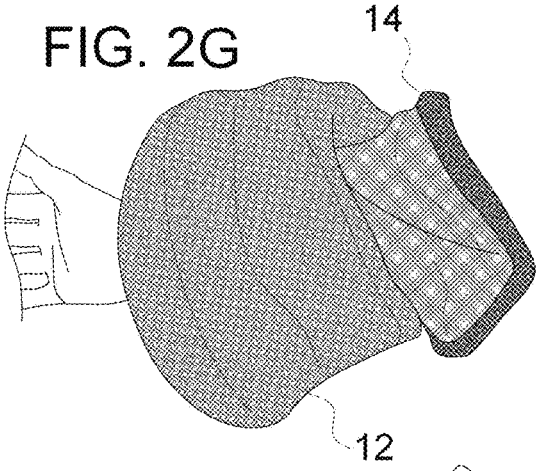
Figure 2I:
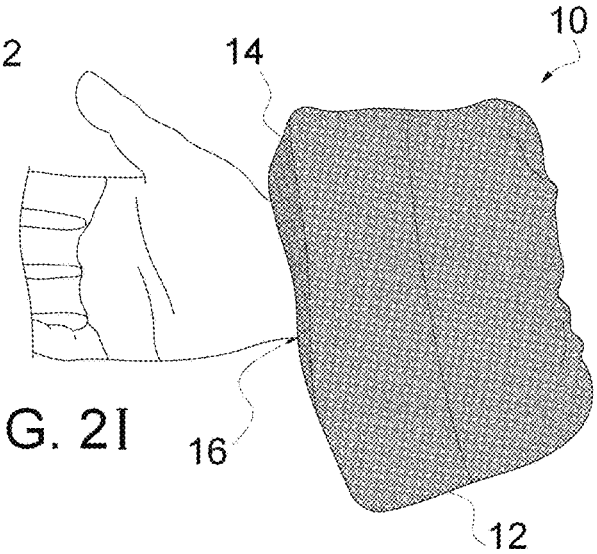

FIGS. 2E-I schematically illustrates, progressive steps for forming the rolled sleeve 10 of FIGS. 1 A-C from a compression bundle netting sleeve material 12 of FIGS. 2C and D. The rolled sleeve 10 will hold the donut or torus shape for ease of loading onto the pneumatic nozzle for forming the compost filter sock. Essentially to form the rolled sleeve 10, following the bunching of the sleeve of netting material 12, one open end 14 of the material 12 is drawn through the open interior 16 and through the other open end 14 as shown in FIG. 2E. The open end 14 is then wrapped around the exterior as shown in FIG. 2F, at least once. To form a tight rolled sleeve 10 the open end can be pulled through a second time as shown in FIG. 2H and then wrapped around the exterior thereby forming the shape holding rolled sleeve 10, which is of a torus or donut shape.

Figure 4A:
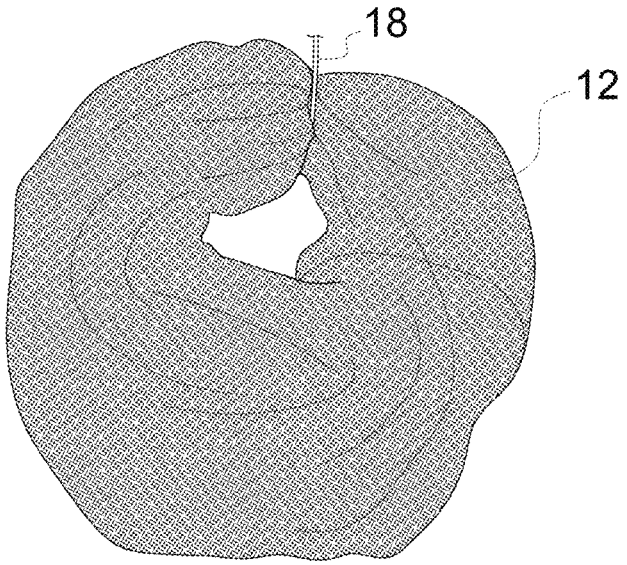
FIG. 4A illustrates a compression bundle netting sleeve with a mechanical fastener holding sleeve in position.

An alternative version of the present invention, rather than forming the rolled sleeve 10, is to secure a mechanical fastener 18 around the compression bundle netting sleeve to hold the compression bundle sleeve in position as generally shown in FIG. 4A. The mechanical fastener 18 may be one of a twist tie, cable tie, hose tie, zip tie or tie-wrap. One minor disadvantage of this aspect of the present invention is that the secured fastener must be removed by the operator, who may not have a convenient tool (e.g., pocket knife) for removing the fastener. As discussed below the rolled sleeve 10 version may be provided with a separate fastener 18 for use on residual portions of the sleeve material 12 after a portion has been used. It is helpful if the operator has a pocket knife or the like to reuse the fastener 18 tied residual portion, but with the rolled sleeve design, should the operator not have a convenient tool he can use new rolled sleeves 10.

Figure 6:
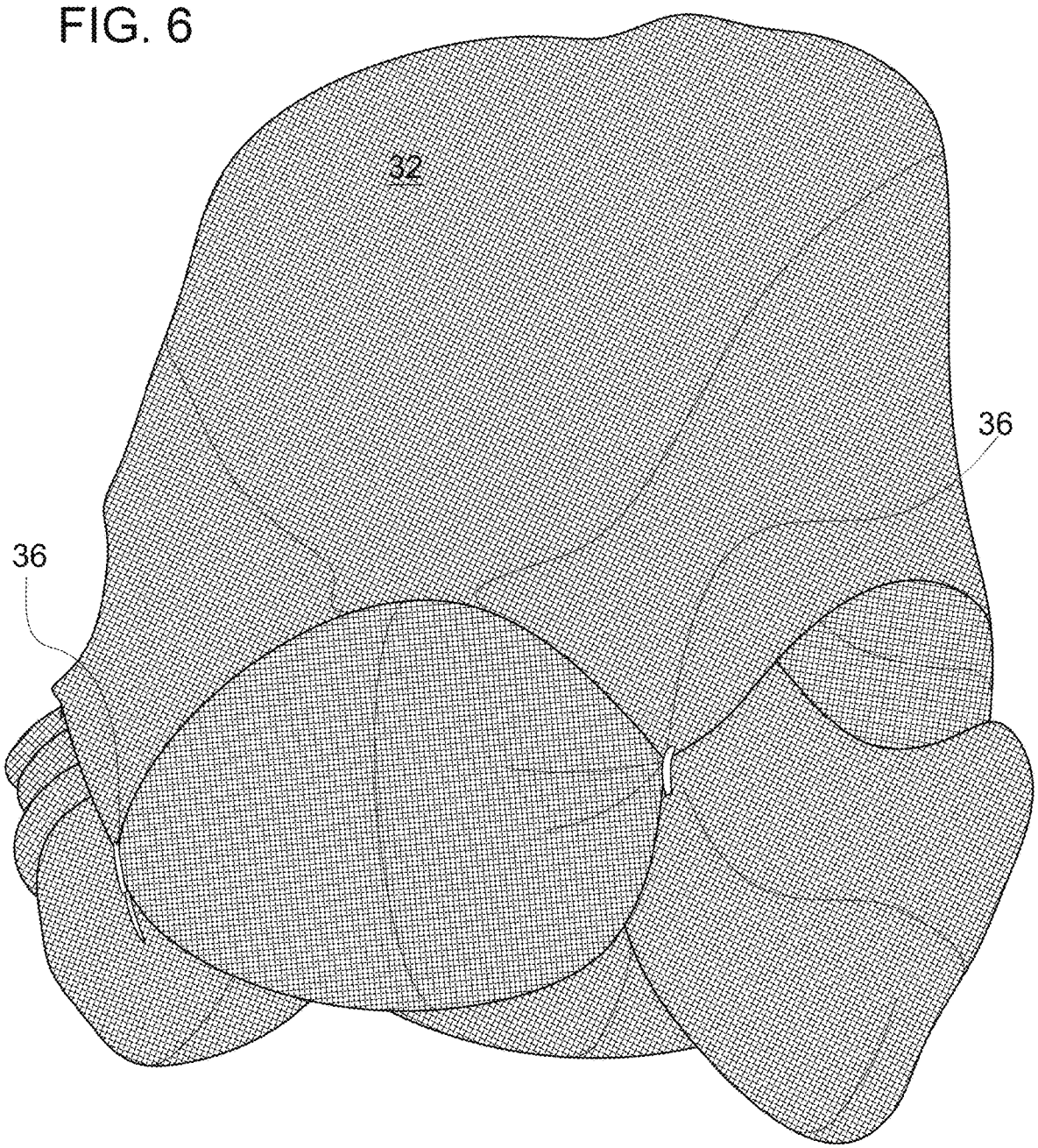
FIG. 6 is a perspective view of the compression bundle netting sleeve with protective holding sleeve holding the netting sleeve in position of FIG. 5.

A further alternative of the present invention, rather than forming the rolled sleeve 10, is to wrap a protective holding sleeve 32 around the compression bundle netting sleeve to hold the compression bundle sleeve in position as generally shown in FIGS. 5 and 6, with fasteners 36 securing overlapped ends 34 of the sleeve 32 in position to hold the sleeve 32 and the associated encapsulated compression bundle netting sleeve in position. The protective holding sleeve 32 is preferably formed as a short length of heavy duty mesh tubing generally the same or slightly larger in diameter than the material 12. The protective sleeve 32 is run through the open interior 16 of the compression bundle netting sleeve and the ends 34 are overlapped and coupled with a plurality of fasteners 36, which may be clips, staples, plastic zip ties or the like. The embodiment of FIG. 5 is similar to the embodiment of FIGS. 4A and B in that a separate holding member, such as fastener 18, is used in the form of the protective holding sleeve 32. The fasteners 36 may be formed as much smaller than fasteners 18 due to their implementation and thus can represent an easier fastener to sever when using the material 12. The protective holding sleeve 32 allows the compression bundle netting sleeve to be protected in the field until use. The holding sleeve 32 and the compression bundle netting sleeve of material 12 can be placed together onto the feeding nozzle and the sleeve 32 only removed once the material 12 is needed. The sleeve 32 is particularly helpful in environments in which the compression bundle may be dragged along the ground before use or otherwise exposed to a harsh environment prior to use.

Vacuum Pack It

After the compression bundle netting material is held in place through the formation of a rolled sleeve 10 or through a mechanical fastener 18 or through use of protective holding sleeve 32, it is placed in a sealable vacuum bag 20. There are two embodiments of the bag 20. One is a resealable bag 20 with the resealing closure 22 (generally downstream of an original sealing line formed with original packaging). A second bag 20 type is effectively formed from a tube member with one end being heat sealed the bag then cut to length from the tube of material and filled and sealed. The use of tube material for forming bags 20 allows the system to easily form distinct sizes of product as the bags 20 will be individually customized to the desired size. The disadvantage of the tube of material is that is prevents the easy incorporation of resealing mechanism—however the resealing may not be desired, or worth the extra cost in all applications and the cost savings of customizable sealed bags 20 from a single tube of material be beneficial.

Figure 4B:
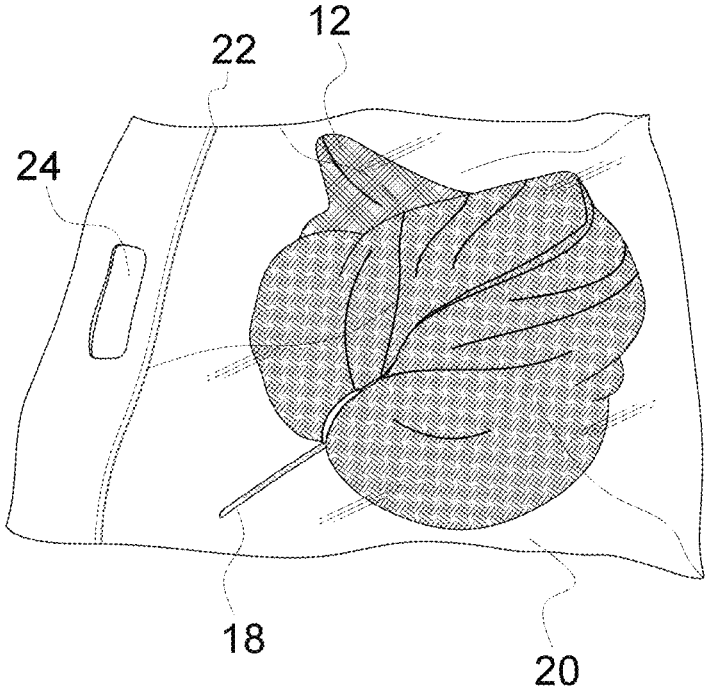
FIG. 4B illustrates the compression bundle netting sleeve with fastener stored with in a re-sealable bag.

An unused fastener 18 may be placed into the sealable bag 20 to allow the user an easy mechanism to hold the compression bundle shape of a remainder of the netting material 12 after the job is completed. The remnant piece of material 12 may be several hundred feet long and the use of a fastener 18 and sealable bag 20 can allow for efficient storage and easy reuse of remnant pieces of sufficient length, particularly if a resealable bag 20 is used. Such use is shown in FIGS. 4A and B. FIG. 4A illustrates a remnant length of compression bundle netting sleeve material 12 with a mechanical fastener 18 holding sleeve in position; and FIG. 4B illustrates the compression bundle netting sleeve material 12 with fastener 18 stored within the re-sealable bag 20.

Following the provision of the rolled sleeve 10, or a compression bundle with fastener 18 or a compression bundle with protective holding sleeve 32, within the bag 20, a vacuum is drawn within the bag 20 to compress the compression bundle or rolled sleeve 10 and the volume reduced bag 20 is sealed. The sealing is easily accomplished with a heat sealing, and if the closure 22 is present then the sealing line is closer to the end than the closure. In some bags 20 the closure 22 itself may be used to seal the bag 20, however this requires the closure to be designed to hold the vacuum and may unnecessarily increase the cost of the bag 20. Heat sealing spaced from the closure 22 allows the closure 22 to only be sufficient for sealing. Further as identified above, the use of a tube of material for forming customizable bags 20 with two heat sealed ends is very cost effective, but generally eliminates the resealing aspects of the bag 20 by eliminating the closure 22. The shape of the rolled sleeve 10 allows for effective vacuum packing of the present invention which in turn results in substantial reduction in volume and associated reduction in shipping costs and ease in provision of material 12 to the field, which field location may and often is a remote, difficult to access location.

Pneumatic Nozzle Loading

Figure 3A:
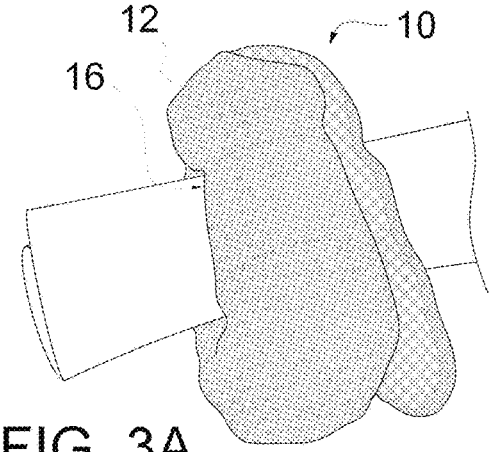
FIGS. 3A-F illustrate the mounting of the rolled sleeve of FIGS. 1A-C on a pneumatic nozzle and the preparation for forming a compost filter sock with the rolled sleeve of FIGS. 1A-C.
Figure 3B:
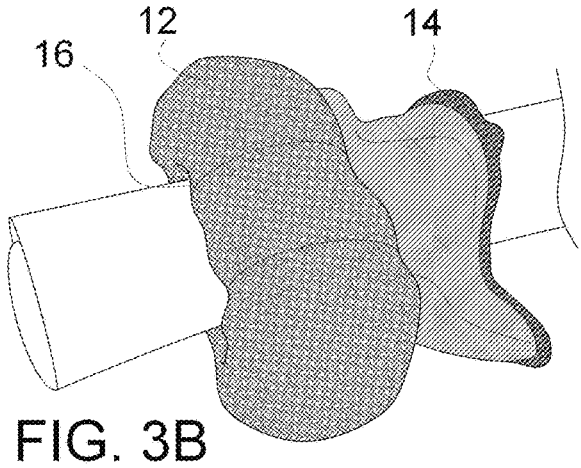
Figure 3C:
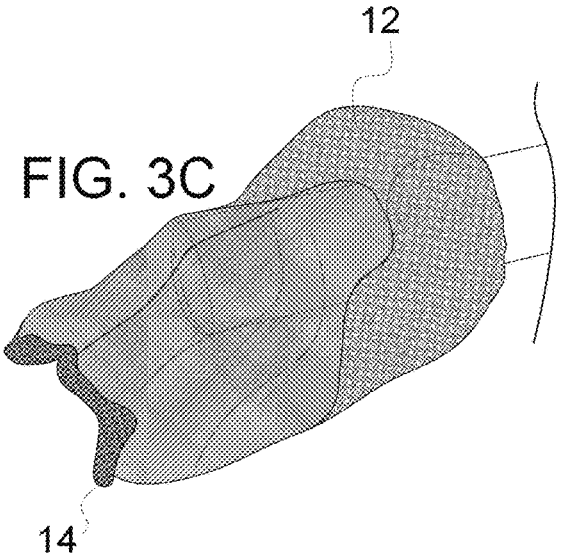
Figure 3D:
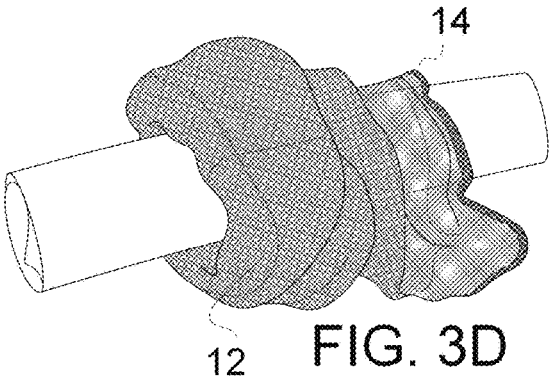

The self holding compressed netting sleeve material 12 allows for rapid loading of the pneumatic nozzle in the field. FIGS. 3A-F illustrate the mounting of the rolled sleeve 10 of FIGS. 1A-C on a pneumatic nozzle and the preparation for forming a compost filter sock with the rolled sleeve 10 of FIGS. 1A-C. The method of manufacturing a compost filter sock using the rolled sleeve 10, or fastener 18 or sleeve 32 held compression bundle netting sleeve material 12, first comprising the step of providing a bag 20 containing a compression bundle netting sleeve such as shown in FIG. 1C and formed as discussed above. The compression bundle netting sleeve material is removed from the bag 20. Next the torus or donut shaped netting material 12 is loaded or placed onto the pneumatic nozzle as shown in FIG. 3A.

Figure 3E:
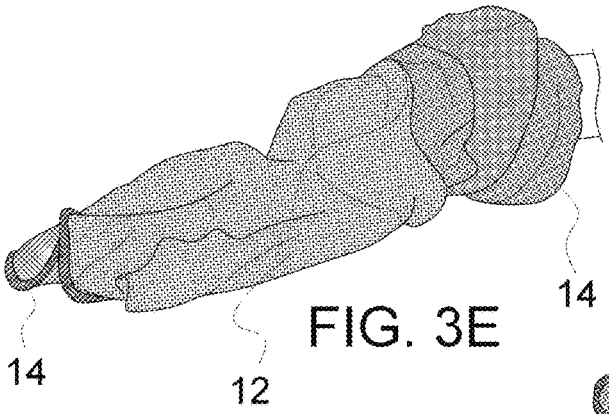

Following this loading, one open end 14 and a leading length of the netting sleeve 12 is removed or pulled from from the pneumatic nozzle while maintaining the opposite end 14 and the remainder of the netting sleeve 12 on the pneumatic nozzle. For the rolled sleeve 10 this entails un-wrapping the leading open end 14, effectively reversing the process used to form the rolled sleeve 10, as shown in the sequential steps of FIGS. 3B-E. For the fastener 18 held embodiment, or for use of a remnant which also uses a fastener 18, this entails removing the fastener 18, typically by cutting, and then merely pulling the leading open end 14 off as shown in FIG. 3E. For the sleeve 32 held embodiment this entails removing the sleeve 32, such as by cutting the fasteners 36, pulling off the sleeve 32, and then merely pulling the leading open end 14 off as shown in FIG. 3E.

Figure 3F:
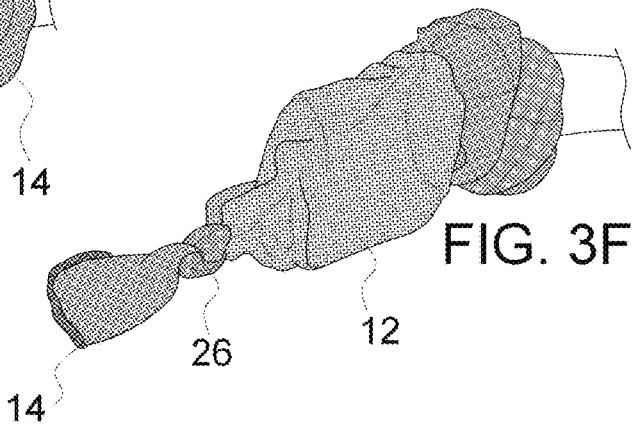

The next step for forming a compost filter sock is sealing the leading open end 14 such as by simply tying a knot 26 in the leading length as shown in FIG. 3F.

Once loaded the compost filter sock is formed in a conventional fashion by filling the netting sleeve 12 with compost using the nozzle (and a supply of compost from a hopper or storage area). After a filter sock of a desired length has been formed the trailing end of the netting material 12 is sealed, such as by another knot 26. IF there is a substantial length of unused netting material 12 after formation of the compost filter sock of a desired length then the material may be severed, generally near where the trailing knot 26 is to be formed and the remaining length of material 12 forming a reusable remnant.

As discussed above the present invention easily accommodates storage of relevant lengths of remnant material 12 after a job is completed. Small remnant lengths will likely be scrapped, or possibly used to fill a leading end of the next compost filter sock.

While the invention has been shown in several particular embodiments it should be clear that various modifications may be made to the present invention without departing from the spirit and scope thereof. The scope of the present invention is defined by the appended claims and equivalents thereto.

What is claimed is:

1. A method of manufacturing a compost filter sock comprising the steps of:

A) providing a bag containing a compression bundle netting sleeve, wherein the netting sleeve includes mesh openings that are small enough to maintain compost within a constructed compost filter sock and large enough to allow runoff water to flow therethrough to allow for formation of a compost filter sock;

B) removing the compression bundle netting sleeve from the bag;

C) placing the compression bundle netting sleeve on a pneumatic nozzle configured for conveying compost for forming the compost filter sock;

D) removing one open end and a leading length of the netting sleeve from the pneumatic nozzle while maintaining an opposite end and a remainder of the netting sleeve on the pneumatic nozzle;

E) sealing the open end;

F) filling the netting sleeve with compost sufficient to form the compost filter sock, wherein the compost is pneumatically conveyed through the pneumatic nozzle; and G) sealing the opposite end.

2. The method of manufacturing a compost filter sock according to claim 1, further including the steps of: removing the remainder of the compression bundle netting sleeve from the pneumatic nozzle following formation of at least one compost filter sock; securing the remainder of the compression bundle netting sleeve with a mechanical fastener; and returning the remainder of the compression bundle netting sleeve to the bag.

3. The method of manufacturing a compost filter sock according to claim 2, wherein the mechanical fastener is one of a twist tie, cable tie, hose tie, zip tie or tie-wrap.

4. The method of manufacturing a compost filter sock according to claim 1, wherein the compression bundle netting sleeve is formed as a shape-holding rolled sleeve of a torus or donut shape by drawing a first open end of a netting material through an open interior of the netting material and through a second open end of the netting material, and then wrapping the netting material around an exterior of the netting material at least once.

5. The method of manufacturing a compost filter sock according to claim 1, wherein the compression bundle netting sleeve is surrounded with a protective sleeve.

6. The method of manufacturing a compost filter sock according to claim 1, wherein the compression bundle netting sleeve is formed by: providing a sleeve of netting material having two open ends; bunching the sleeve of netting material along a longitudinal axis, whereby each open end of the netting material remains accessible to form a compression bundle netting material; and forming a shape-holding sleeve of a torus or donut shape from the compression bundle netting material by one of: i) drawing one open end of the netting material through an open interior of the netting material and through the other open end, and then wrapping the netting material around an exterior of the netting material at least once; ii) securing the compression bundle netting sleeve in position within the bag with a mechanical fastener which is one of a twist tie, cable tie, hose tie, zip tie or tie-wrap; and iii) securing the compression bundle netting sleeve in position within the bag with an encapsulating mesh protective sleeve.

7. The method of manufacturing a compost filter sock according to claim 6, wherein the bag is a sealable bag, and wherein the method further includes the steps of: placing the compression bundle netting material in the sealable bag, and sealing the sealable bag.

8. The method of manufacturing a compost filter sock according to claim 7, further including the step of placing a mechanical fastener capable of securing the compression bundle netting sleeve in position within in the bag.

9. The method of manufacturing a compost filter sock according to claim 8, wherein the mechanical fastener is one of a twist tie, cable tie, hose tie, zip tie or tie-wrap.

10. The method of manufacturing a compost filter sock according to claim 9, wherein the bag is resealable.

11. The method of manufacturing a compost filter sock according to claim 1, wherein the compression bundle netting sleeve is surrounded with a protective sleeve and wherein ends of the protective sleeve are overlapped and coupled together.

12. The method of manufacturing a compost filter sock according to claim 11, wherein the ends of the protective sleeve are coupled together with a plurality of fasteners formed by one of clips, staples, or zip ties.

13. The method of manufacturing a compost filter sock according to claim 11, wherein the netting sleeve has a circular cross section.

14. The method of manufacturing a compost filter sock according to claim 13, wherein the netting sleeve has a diameter between 8" and 24".

15. The method of manufacturing a compost filter sock according to claim 14, wherein a material of the netting sleeve is one of polyester, polypropylene, cotton, or nylon material.

16. The method of manufacturing a compost filter sock according to claim 14, wherein the protective sleeve is formed of netting material.

17. The method of manufacturing a compost filter sock according to claim 16, wherein the protective sleeve is formed as a length of mesh tubing shorter than a length of the netting sleeve.

18. The method of manufacturing a compost filter sock according to claim 17, wherein a diameter of the protective sleeve is at least equal to a diameter of the netting sleeve.

19. The method of manufacturing a compost filter sock according to claim 1, wherein the compression bundle netting sleeve is surrounded with a protective sleeve, wherein the protective sleeve is formed of netting material, and wherein ends of the protective sleeve are overlapped and coupled together with a plurality of fasteners.

* * * * *